US005137225A

United States Patent [19]

Biagiotti

[11] Patent Number: 5,137,225

[45] Date of Patent: Aug. 11, 1992

[54] REWINDING MACHINE FOR THE FORMATION OF ROLLS OR LOGS, AND WINDING METHOD

[75] Inventor: Guglielmo Biagiotti, Capannori, Italy

[73] Assignee: Fabio Perini S.p.A., Lucca, Italy

[21] Appl. No.: 547,169

[22] Filed: Jul. 2, 1990

[30] Foreign Application Priority Data

Jul. 11, 1989 [IT] Italy ..... 9476 A/89

[51] Int. Cl.[5] ..... B65H 18/20; B65H 18/00

[52] U.S. Cl. ..... 242/66; 242/56 R

[58] Field of Search ..... 242/66, 56 R

[56] References Cited

U.S. PATENT DOCUMENTS

| | | | |
|---|---|---|---|
| 4,121,409 | 10/1978 | Uchida et al. | 242/37 A |
| 4,327,877 | 5/1982 | Perini | 242/66 |
| 4,721,263 | 1/1988 | Mayazaki | 242/55 |
| 4,723,724 | 2/1988 | Bradley | 242/56 R |
| 4,828,195 | 5/1989 | Hertel et al. | 242/66 |
| 4,931,130 | 6/1990 | Biagiotti | 242/56 R |

*Primary Examiner*—Daniel P. Stodola

*Assistant Examiner*—John Q. Nguyen

*Attorney, Agent, or Firm*—Francis J. Bouda

[57] ABSTRACT

The rewinding machine of the present invention produces rolls or logs of paper such as toilet paper, kitchen towels, etc. It includes an upper winding cylinder (9; 109), a lower winding cylinder (10) forming with the upper one an interspace (12), a mobile roller (14) able to define with said two cylinders a space in which the roll is wound. A pusher (22) inserts individual cores (A) in said interspace, and an applicator (34, 36, 38) wets the cores with adhesive. In combination with one (9; 109) of the two winding cylinders (9, 109; 10) a fixed surface (52; 80) is provided. A web of incoming paper N slides along the surface (52; 80). The pusher (22) moves the core (A1) at an insertion speed which is lower than the paper-feeding speed. During its insertion into the interspace (12) the core (A1) moves toward the fixed surface (52; 80), providing a temporary braking effect on the web N lying between the fixed surface (52; 80) and the core (A1). This causes the web to tear between the just-completely formed roll (R) and the incoming core (A1).

18 Claims, 6 Drawing Sheets

Fig.10
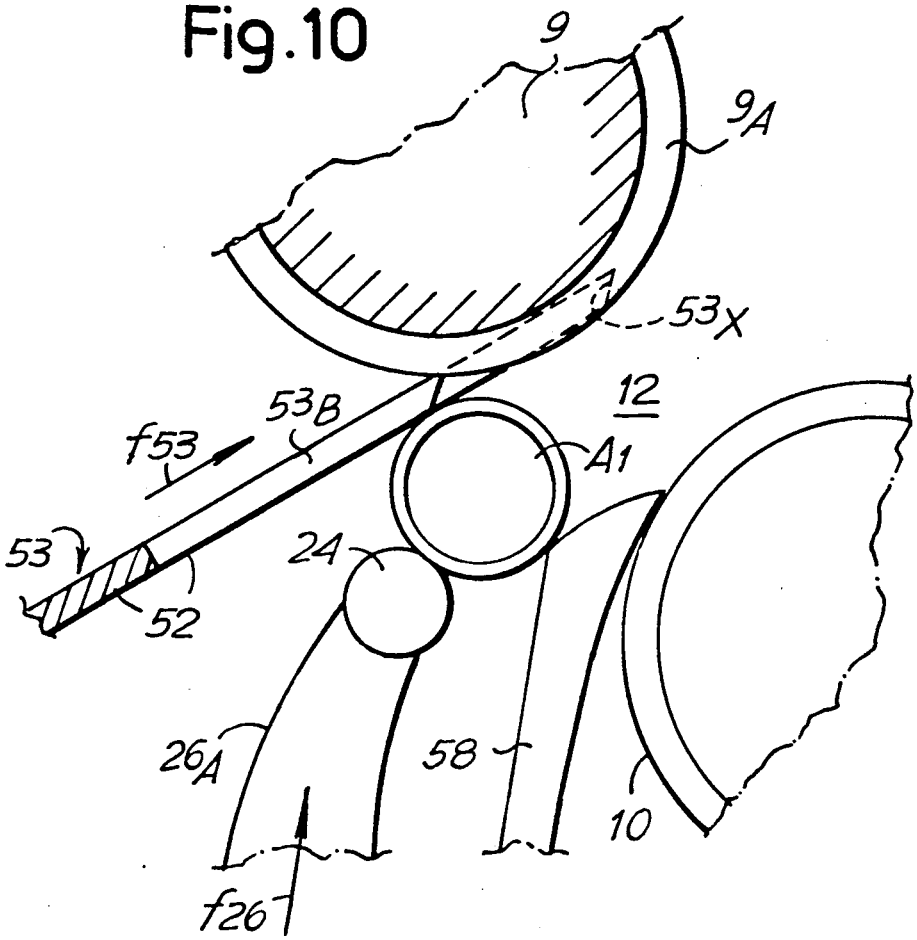
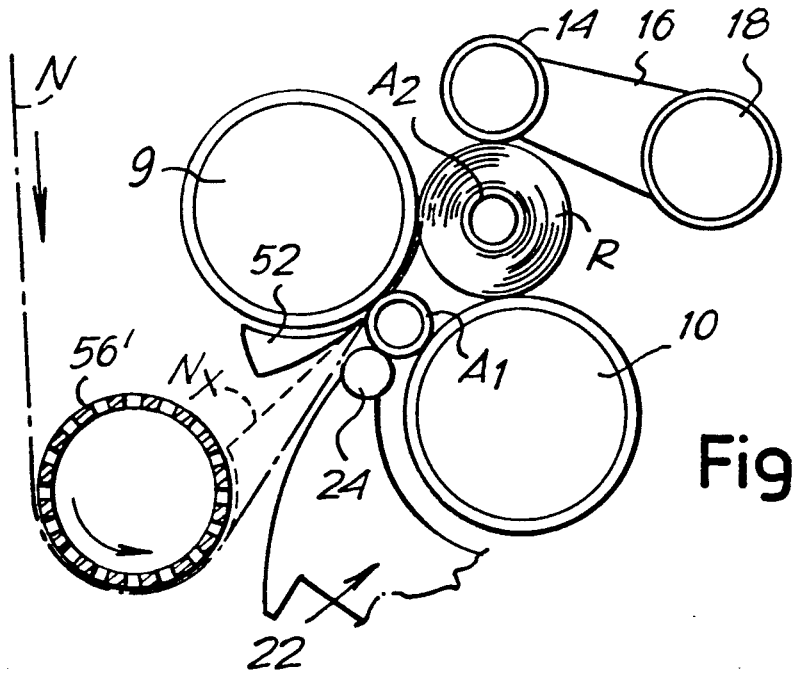
Fig.11

REWINDING MACHINE FOR THE FORMATION OF ROLLS OR LOGS, AND WINDING METHOD

BACKGROUND OF THE INVENTION

The winding of small-diameter rolls or logs of paper from large-diameter "parent rolls" is well known. Early devices utilized a center shaft rewinding system, including a mandrel of 1.5" to 1.7" diameter and of a length that corresponds to the width of the tissue parent roll which comes from the paper machine, usually in width from 65" to 155". As the paper gets wound onto the thin paper core which has been mounted on top of the mandrel, the rotation or the speed of the mandrel has to be changed constantly as the diameter increases, because the surface speed of the paper remains more or less constant. Early machines had only two mandrels, but with the revolution of the technology, there are now center shaft rewinders with as many as eight shafts, mounted in a turret for quick and automatic changeover from one cycle to the next in order to manufacture the logs of tissue. The inherent limitations of a center shaft winder is that the small mandrel is very long, usually 10" to 14" longer than the width of the paper, and therefore is exposed to deflections due to the force of gravity and centrifugal forces. Besides, any small imperfection in the mandrel or the core would induce vibrations, because at the usual speeds of 2000 to 2200 feet per minute, these mandrels have to start rotating at speeds of 5000 to 6000 RPMs.

On the other hand, the current technology is quite different because it uses a surface winding principle whereby on a steel drum the log is formed without the use of mandrels. This different winding principle made it possible to considerably simplify the machine, therefore making its operation much easier, maintenance much cheaper, and its flexibility much higher. Furthermore, it permitted to make machines wider than 100".

Recent "cradle-roll" machines which have eliminated the shafts and permitted more efficient and productive operations are shown in U.S. Pat. Nos. 4,327,877 (Perini); 4,909,452 (Hertel; 3,148,843 (Turner); 4,588,138 (Spencer) and 4,723,724 (Bradley).

To separate the web at a precise moment, remove a completed log, attach the leading edge of the just-separated web to a new core and continue the winding process, on the new core, is the subject of this invention. It distinguishes over the prior art in the arrangement of elements to tear the web at the instant one roll or log is completed, and commence winding a new roll without interrupting the flow of the web coming into the winder.

DESCRIPTION OF THE INVENTION

The winder of the present invention includes an upper winding cylinder, a lower winding cylinder forming with the upper one an interspace, a mobile roller, able to define with said two cylinders the space for the winding of the roll. Means are provided for the insertion of individual cores into said interspace, and means for wetting the cores with adhesive. The relative peripheral speed between said two winding cylinders may be cyclically variable.

One object of the invention is to provide a machine of the above-mentioned type allowing both a regular tear of the web after the formation of a complete roll and a regular start of the next winding.

In combination with one of two winding cylinders, a fixed surface is provided along which the incoming web slides immediately before reaching the said interspace. A pusher moves the core at an insertion speed which is lower than the web feeding speed and the arrangement is such that the core, during the travel into the interspace, pushes the web against a fixed surface, thereby causing a braking effect on the web lying between the same surface and the core. This causes the web to tear between the just-completed roll and the incoming core on which the winding of the web must be started.

By this disposition, the simple insertion of the core into the interspace between the winding cylinders causes, owing to the pinching of the paper between the core and the fixed surface, the tearing of the material and the anchoring of the free edge thereof on the core surface. The winding is made to start without reversing the feeding speed of the free edge of the torn web.

Particularly advantageous embodiments of the machine are set out in the following description. In particular, along the path of core insertion into said interspace, members opposite to said fixed surface may be provided; in this case, during its insertion the core is caused to pass between said members and said fixed surface. The braking effect may take place not only during the insertion of the core between the fixed surface and the members opposite thereto, but also when the core, being inserted, reacts between said fixed surface and the lower winding cylinder.

The web being wound may be continuous (i.e., not perforated); however, in a particularly advantageous embodiment, the machine may comprise means for the perforation of the web, the tear of same web occurring, in this case, along a perforation line. Advantageously, means may be provided to synchronize the feeding movements of the core into the interspace between said winding cylinders, the synchronization being such as to provide always a single line of perforation between the roll being completed and the incoming core, so that the tear of the web takes place always along said perforation line.

The fixed surface may be changeable and/or adjustable in order to change its position with respect to the interspace between the winding cylinders.

In one embodiment, the fixed surface is made of a structure developed along one of the winding cylinders and between this cylinder and a facing auxiliary driving roller.

In another embodiment, the fixed surface is formed by an arcuate laminar lining which follows the surface of the upper winding cylinder at a region within the arc of the web arriving at said cylinder, said laminar lining being angularly adjustable about the axis of the same cylinder.

The winding cylinder may include a bearing shaft and adjacent cylinder sections; the arcuate laminar lining is, in this case, carried by supports connected to the bearing shaft and disposed between the adjacent sections making up the winding cylinder and outside thereof.

Advantageously, the bearing shaft may be supported by a frame having a rolling bearing in a space between adjacent sections of the cylinder. The means for adjusting the position of said surface operating, in; this case, between said supports and said frame.

The machine may advantageously include a mobile "dancing" roller upstream of said surface, to compensate for possible slackenings of the incoming web. This mobile roller may be resiliently urged or even cyclically displaced by drive means synchronized with the core insertion means.

The mobile roller may be replaced by other means to take up the web and compensate for the slackening thereof. For example, a suction box may be provided in which the possible surplus of web is accumulated, forming a loop.

Alternatively, the mobile roller may be replaced by a roller having a fixed axis and with suction means to cause the web to adhere on the cylindrical surface thereof.

Whatever the means used for taking up the excess of web and/or for compensating the slackening thereof, it is necessary to provide means to recover the excess of web. To this end, provision may be made so that the roller and the cylinders, which operate the winding of the web on the roll in the course of formation, be rotated so that the winding speed will tend to be constantly slightly greater than the web feeding speed.

It is also possible that the cylinders and the winding roller be temporarily accelerated to recover the excess of web accumulated during the previous core replacement phase. To this end, sensors may also be provided to detect the presence of an excess of web by determining, for example, the position of the mobile roller, or by detecting the presence of a web loop within the suction box, or also by sensing the arc on which the web is wound over the suction roller. Depending on the signal supplied by said sensors, an acceleration or a deceleration of the winding cylinders may be made.

The invention refers also to a method for the formation of logs or rolls of web material, wherein a core, on which the roll is to be formed, is inserted between two winding cylinders in order to come in contact with the web fed to said cylinders and driven around one of them or around an auxiliary cylinder, and wherein, when the roll in the course of formation is complete, it is moved away from the formation area by slowing down one of the winding cylinders, while the core for the formation of the successive roll is brought close to said winding cylinders.

According to the invention, the method is characterized in that: the core for the formation of the successive roll, wet with adhesive, is caused to press the incoming web against a fixed surface to cause a sudden slowing down thereof and then to tear between its point of contact with the core and the point of tangency with the formed roll. The incoming free edge, after the tear, adheres to the core surface and is wound thereon without reversing the feeding direction.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIGS. 10 and 11 show details of further embodiments.

Figure 1:
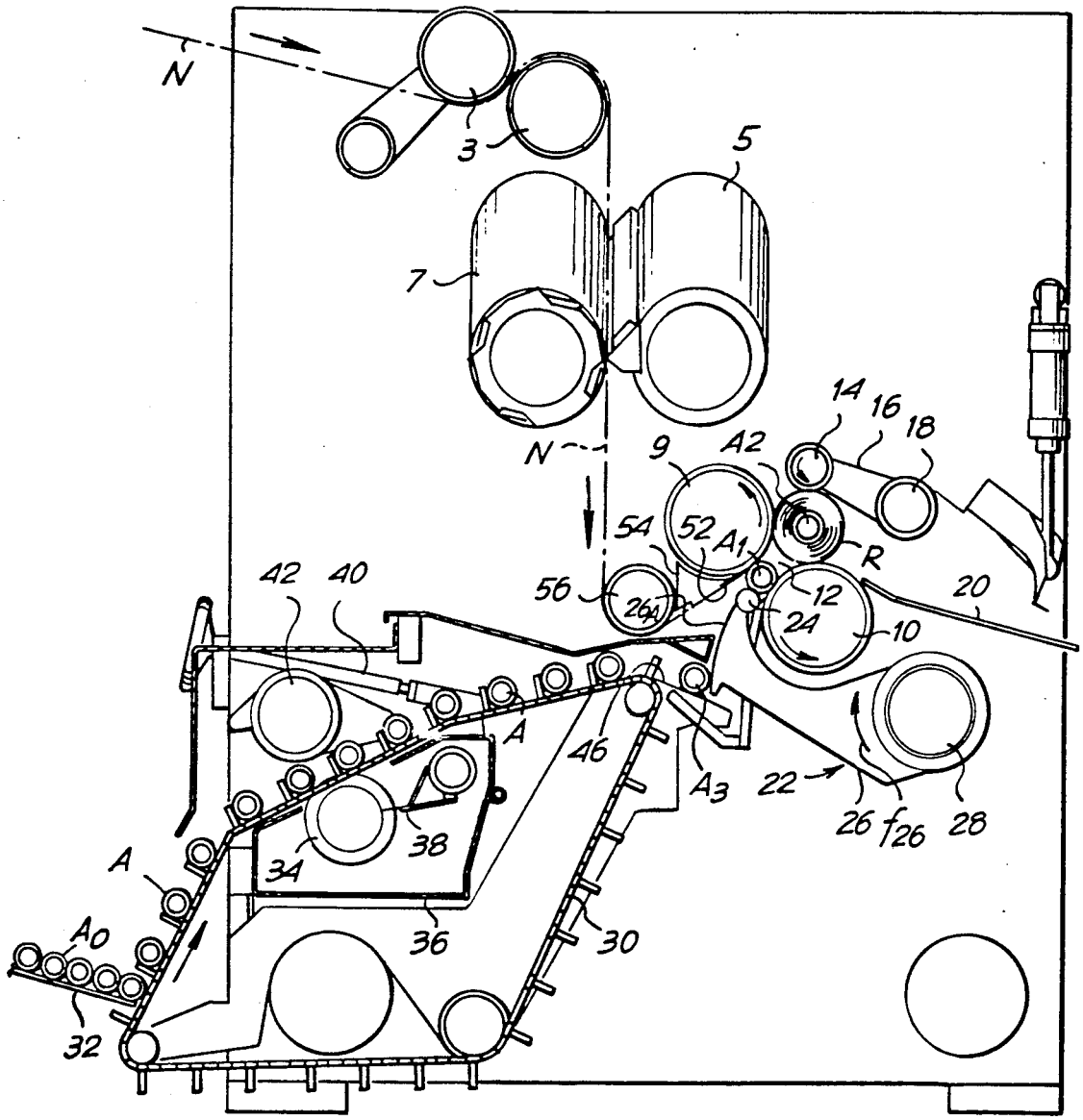
FIGS. 1 and 2 show two diagrams of possible embodiments of a rewinding machine.

Referring to FIG. 1 of the attached drawing, N indicates the web of paper which passes between two rollers 3 which control its feeding speed and the downstream tension thereof. It then passes between two perforating cylinders 5 and 7 of known type, to carry out the transverse perforation of the web and to determine the length of the individual sheets in the rolls formed by the rewinding machine.

Numeral 9 indicates an upper winding cylinder and numeral 10 a lower winding cylinder which form between them an interspace or nip 12 for the insertion of a core A1. A third movable roller 14 is mounted on arms 16 pivoted at 18, so as to move close to and away from the pair of winding cylinders 9 and 10. R indicates a roll or log being formed on a core A2 previously inserted into the interspace 12. Numeral 20 indicates a plane for the removal of a complete roll.

Numeral 22 indicates a means for pushing or inserting a core A1 into the interspace 12. This insertion means 22 includes a pusher 24 in contact with the core to be inserted, said pusher being carried by arms 26 pivoted at 28 to the fixed framework. The arrangement described above is able to form a roll or log R of web material N, the reeling taking place by contact with the winding cylinders 9 and 10, and with the third mobile roller 14. Roller 14 is progressively moved away as the diameter of roll R in the course of formation becomes gradually larger, while maintaining the contact therewith all the time. When the roll R is completed, it is discharged in the direction of the surface 20 by the deceleration of roll 10, while a new core A1 is inserted into the interspace 12 by the movement of arms 26, in the direction of arrow f26, around the axis 28. Means must also be provided to separate the web N in the portion between the formed roll R and the inserted core A1, and to this end, there is provided the arrangement described below.

The cores A are fed by a continuous conveyor 30 provided with a series of seats for the cores and advancing one step for each core required for the winding. The advancement may be continuous or intermittent. The cores are supplied from a container (not shown) from which the cores A0 move forward along a feeding plane 32 to reach the conveyor 30, which collects one core after another to transfer them to the region where they are inserted by the inserter 22. Along the trajectory of conveyor 30, the cores are wet with adhesive at predetermined areas. This may be achieved in any well-known manner, for example, by a distributor cylinder 34 which picks up the liquid adhesive out of a tank 36 and cooperates with a scraper 38 to control the amount of adhesive which adheres to the distributor cylinder 34 and which is applied to the passing cores. Numeral 40 indicates a screw adjustment system for setting the distance of the scraper 38 from the distributor cylinder 34, in order to control the amount of adhesive.

Numeral 42 indicates a counter-roller which cooperates with the distributor cylinder 34 during the application of the adhesive. The spreading of the adhesive may take place at annular areas spaced along the core, in which case the core itself is caused to roll between the cylinders 34 and 42. Alternatively, the adhesive may be distributed along an axial line or lines on the outer cylindrical surface of the core, for example, by means of an application cylinder coming in contact with the core along a line.

The cores A are then carried by the conveyor 30 to a remover tray 46 and are individually and successively kept in position A3 both by said tray and the face 26A of arms 26, while these are moved from the lowered position for the withdrawal of a core up to the position A1 for the insertion of a core into the interspace 12.

For the formation of the rolls R, the winding cylinders 9, 10 and the mobile roller 14 rotate according to the arrows shown in the drawing. A temporary slowing down of the lower winding cylinder 10 for moving the just completely wound roll away, also moves the core inserted into the space 12 until it passes beyond such interspace. It is in this zone that the new roll is formed, eventually coming into contact with the mobile roller 14 which has been lowered after the previously wound roll has been moved away.

To tear the web, so as to complete the winding of the web material on roll R and start the beginning of a new winding on a core A1 (just inserted by the insertion means 22), there is provided a fixed surface 52 which is combined with the upper winding cylinder. During its insertion between the cylinders by means of pusher 24, the core A1 presses the paper against this surface and holds it until said paper breaks along a perforation line.

Figure 3:
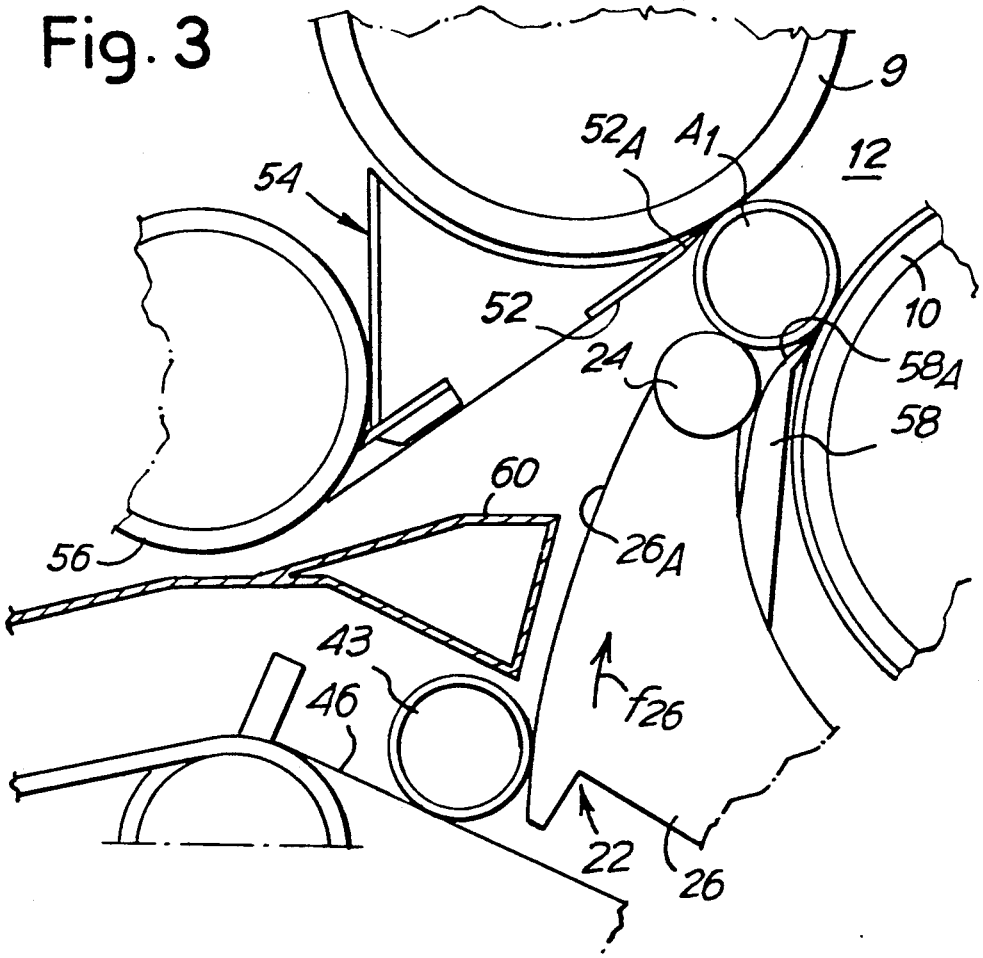
FIG. 3 and 4 show an enlarged detail of two embodiments.

According to FIGS. 1 and 3, the fixed surface 52 is provided having a shape substantially tangent to the upper winding cylinder 9, beginning from the interspace region 12 and extending towards the incoming web material N. The surface 52 is part of a structure 54 of approximately triangular cross-section, associated with an auxiliary driving roller 56. The web N travels around the roller 56, which may be either motor-driven or free-wheeling around the same paper web, until it slides on the fixed surface 52 to reach the upper winding cylinder 9 and the interspace 12.

The core A1, pushed by the insertion means 22, 24, and 26 slides along the edges 58A of fixed members 58, which are substantially parallel to the displacement trajectory of the insertion means 22, 24, 26. The arrangement is such that the core A1 becomes wedged between the edges 58A of the members 58 and the surface 52, pinching the ribbon-like material N between the core A1 and the surface 52.

The speed of displacement in the direction of arrow f26 of the insertion means 22, 24, 26 is lower than the speed of the web material N moving along the surface 52. As a result, the moment the core A1 is pressed against the surface 52, between said surface 52 and the fixed members 58, it slows down the web material N with respect to the peripheral speed with which the material is wound on the roll R at the end of its formation. This causes the tearing of the paper web along the perforation line which is between the point of contact of core A1 on the surface 52 (during the thrust provided by the insertion means 22, 24, 26) and the region of its winding on roll R. The web portion between the point of contact of core A1 on the surface 52 and the region of its winding on the roll R is at least partly out of contact with the upper cylinder 9 owing to the advancement of roll R resulting from the deceleration of cylinder 10. This assures the tearing along the perforation line. Thus the insertion of the core A1 into the interspace 12 causes the web N to tear.

After the web is separated between the just-inserted core A1 and the finished roll the winding on same core A1 begins (owing to the effect of the adhesive applied onto the core A1).

After passing the surface 52 and the edges 5BA of members 58, it comes in contact with the winding cylinders 9 and 10, thus starting a rotation according to the arrow shown in FIG. 3. The reduction of the speed of the lower winding cylinder 10 causes the movement of the core A1, which has begun the winding, towards the third mobile roller 14 which, in the meantime, after the removal of the preceding roll R, moves down towards the interspace 12. This ensures the winding of the material on the new roll by the contact thereof with the winding cylinders 9 and 10 and with the mobile roller 14.

In the foregoing, reference has been made to a plurality of members 58 equal and parallel to each other, spaced apart an extent as not to interfere with the rings of adhesive distributed on the core. It is also evident that the same effect is obtained by using a continuous member which has a core-supporting surface having slots in alignment with the regions on which the adhesive is spread.

Figure 4:
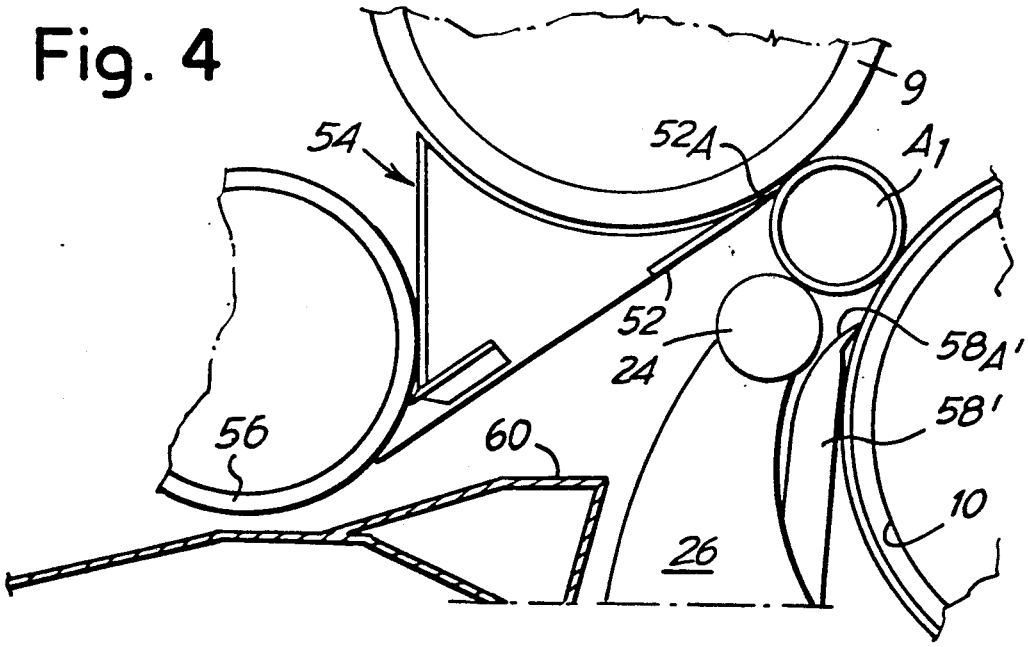

The embodiment of FIG. 4 is similar to the embodiment of FIG. 3, and parts in common to the two embodiments are designated by the same reference numbers. In FIG. 4, the members 58 have a more limited development, so that their edges 58A' (corresponding to the edges 58A) are not as close to the front edge of surface 52. In this way, when the core is wedged between the members 58 and the surface 52, it causes the paper to be pressed against said surface 52 by reacting against the winding cylinder 10 which, although rotating (even if at reduced speed) and being influenced by the effect of the core inertia as well, is not able to rotate the core prior to the tearing of the paper web as described above with reference to the embodiment of FIG. 3.

Figure 8:
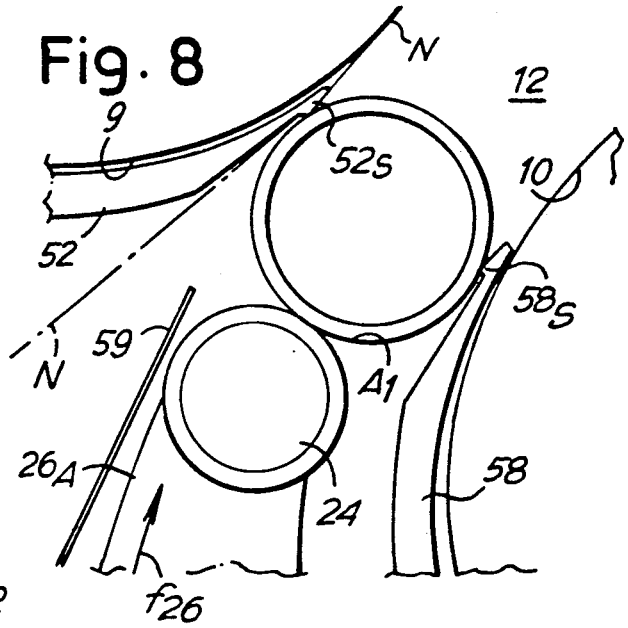
FIG. 8 shows an enlarged detail, corresponding to the details of FIGS. 3 and 4, in a modified embodiment.

FIG. 8 shows an enlarged detail corresponding to the detail of FIG. 3, in a slightly modified embodiment. In this embodiment, the elements corresponding to those of FIG. 3 are designated by the same reference numbers. In this case, the surface 52 has a corner 52S (in the vicinity of interspace 12 between the cylinders 9 and 10), which projects opposite to a corner 58S formed on the profiles 58. As clearly shown in FIG. 8, when the core A1 is inserted by the insertion means 22, 24, 26 into the interspace 12, the corners 52S and 58S increase the effect of the pressure on the core and also on the paper web N between said core and the surface 52, thereby ensuring tearing thereof. The corner 58S may also be omitted.

The element on which the surface 52 and the corner 52S are formed may be of comb-like construction, with the ends of the teeth or prongs being received within slots of the cylinder 9. In such case, each tooth of the comb will be provided with a corner 52S projecting to a limited extent beyond the outer surface of cylinder 9.

FIG. 8 shows also a flexible plate 59 disposed upstream of the winding cylinder 9 with respect to the feeding trajectory of core A1. The flexible plate 59 contacts the core A1, which is urged by the insertion means 24 against the members 58, thereby avoiding the contact of said core with the surface 52 until the core has gone past the end of plate 59. Advantageously, the plate 59 may be provided with slits or cuts aligned with the core regions on which the adhesive is spread, in order to prevent the plate from becoming dirty. Similarly, more parallel flexible plates may be provided which act on the regions of core A1 not having any adhesive.

Figure 5:
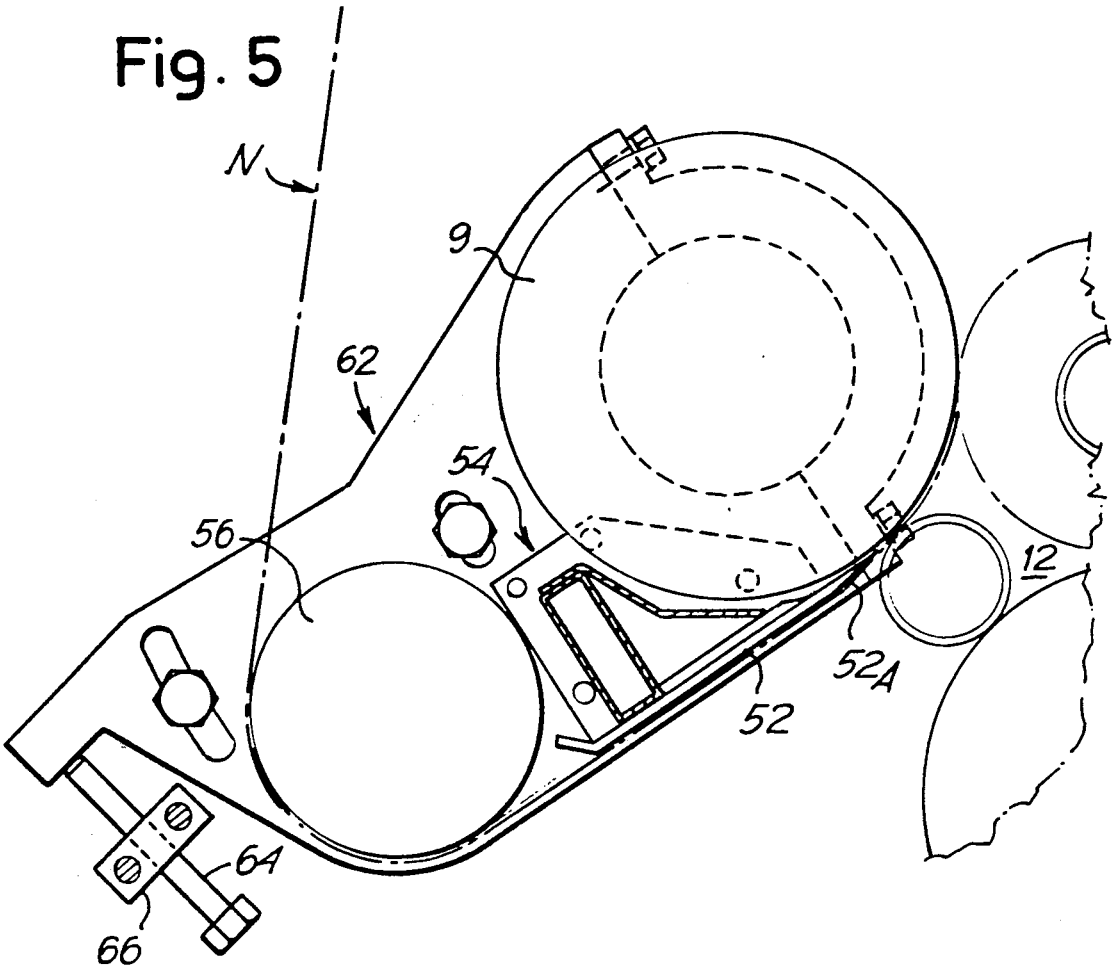
FIG. 5 shows a way of adjusting the fixed surface position.

It is advantageous to provide a regular adjustment of the position of the fixed surface 52 and, in particular, of its terminal edge 52S around the surface of cylinder 9 near the interspace 12 and other members which define this interspace. FIG. 5 shows an embodiment of the means for adjusting the position of surface 52. This surface, with the structure 54 and driving roller 56, is carried by a unit 62 movable about the axis of the upper winding cylinder 9. The position of this unit can be adjusted by a set screw 64 engaged into a threaded hole of a fixed support 66, so as to angularly define the position of the unit 62 and thus the position of the terminal edge 52S of the surface 52 around the surface of the upper winding cylinder 9. The adjustment is achieved within sufficiently close limits.

The stretch of paper web N, which is tensioned to a limited degree, is able to take up any slack likely to be formed by the effect of the web slowing down as a result of the pinching of same web between the surface 52 and the core A1 upon the insertion of the latter.

Figure 2:
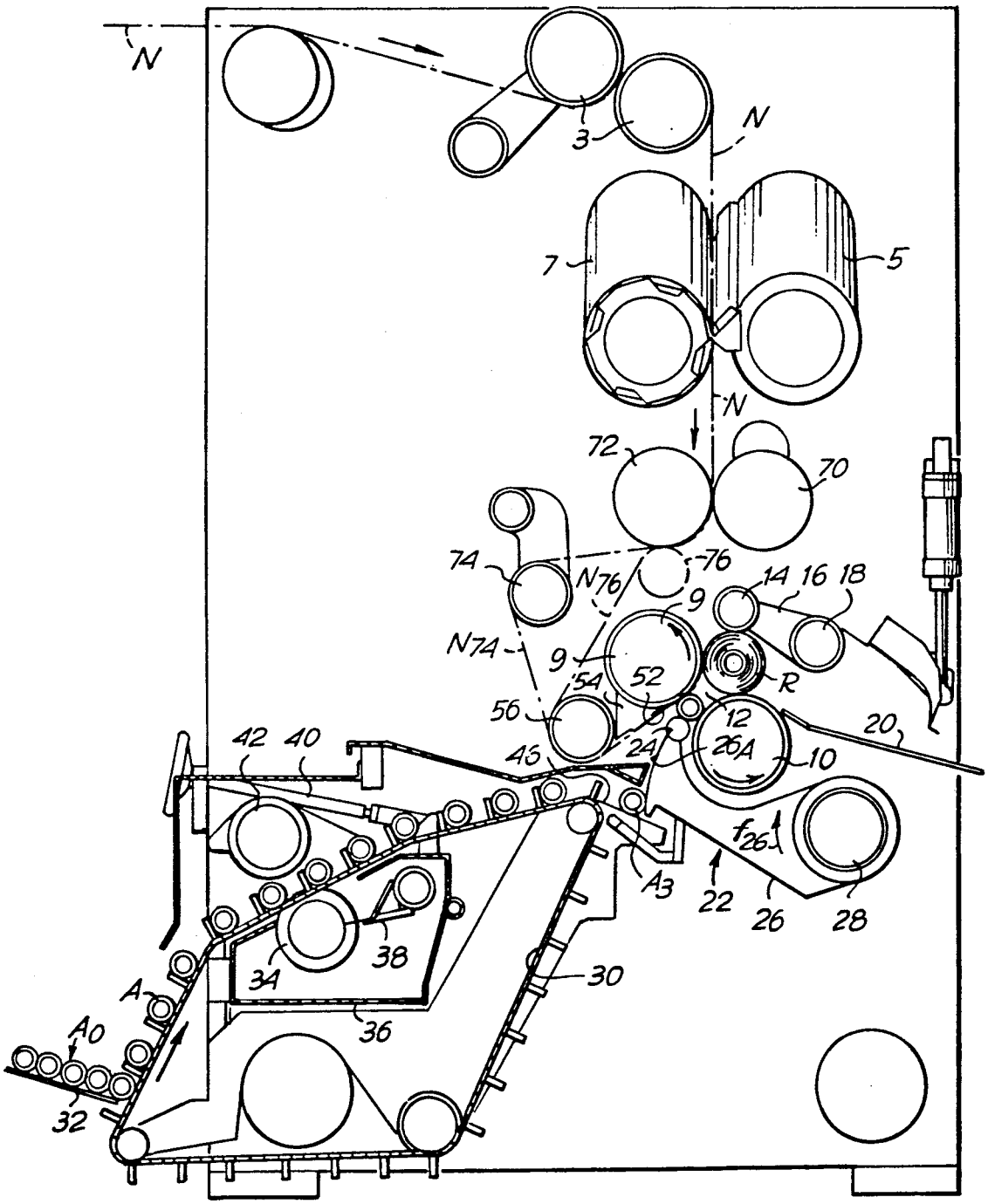

In the embodiment shown in FIG. 2, wherein the same references indicate equal or corresponding members, the web coming from the pair of perforating cylinders 5, 7 reaches a pair of cylinders 70, 72 from which it is diverted to a mobile roller 74 acting as a "dancer" or tightener roller which defines the trajectory between the cylinder 72 and the auxiliary driving roller 56. The dancer roller 74 may be urged resiliently to ensure the tensioning along the portion of trajectory N74. As an alternative, the roller 74 may be actuated by a mechanical drive consisting, for example, of cams or the like, to be moved in synchronism with the web tear and core replacement operations, thereby automatically and immediately compensating for any possible slackening of the web due to the slowing effect caused by the incoming core.

In place of the tensioning roller 74, a similar arrangement may be provided consisting of a roller 76 (shown in chain dotted line) and which is mounted on a unit oscillating about the axis of cylinder 72, so as to determine a tensioning of the web which, in this case, will have a trajectory N76 instead of the trajectory N74 as provided in the case of the use of the "dancer" roller 74.

Figure 9:
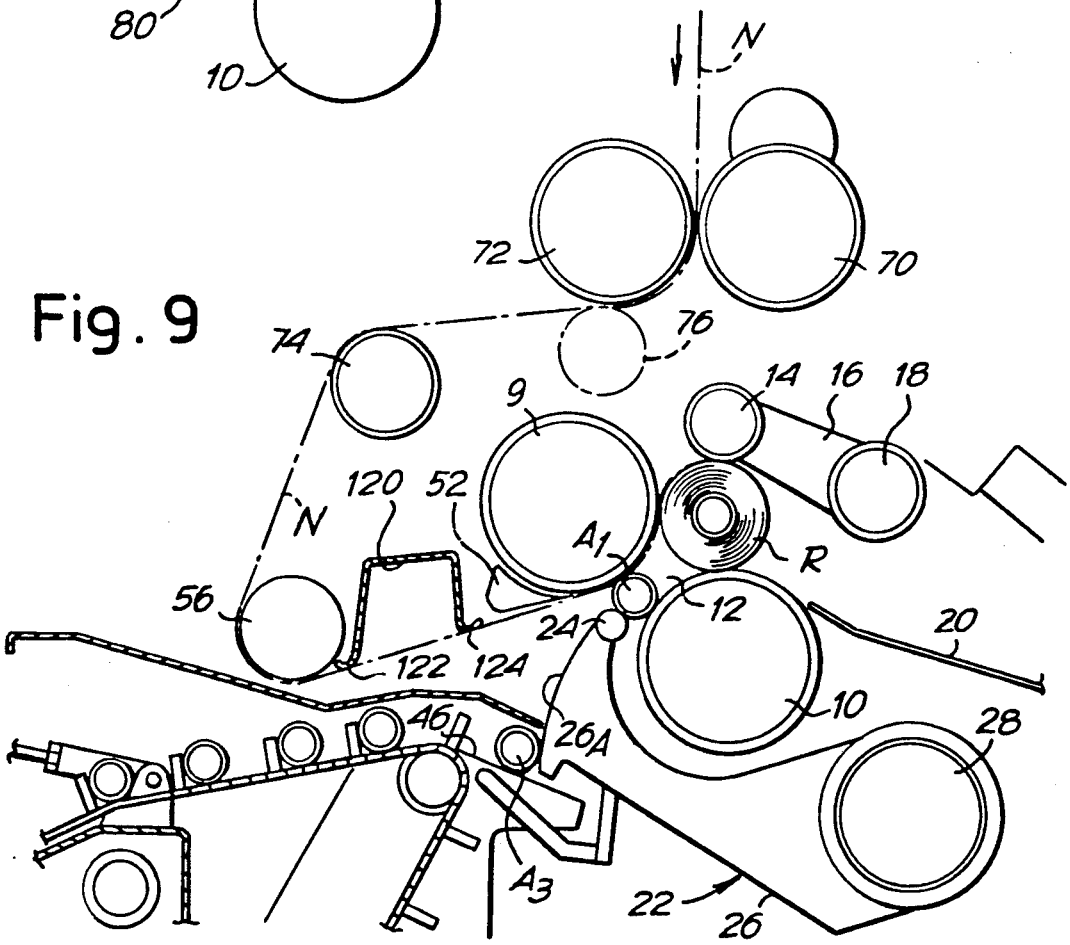
FIG. 9 shows an enlarged detail of the embodiment of FIG. 2, with a different system for the tensioning of the paper.

FIG. 9 shows the winding region of an embodiment of the machine of FIG. 2, with a different system for the tensioning of the paper web. In said FIG. 9, parts corresponding to the embodiments of FIGS. 2, 3 and 4 are indicated by the same reference numbers. In this embodiment, the roller 74 is fixed and performs solely the function of a turning roller, while the recovery of the web and the control of the tension of web N during the working cycle is obtained pneumatically by a suction box 120 arranged transversely across the width of the web N being wound. One side of the suction box 120 is open and the aperture is defined by two edges 122, 124 on which the web N slides. The interior of the box 120 is kept under slight vacuum, for example, by means of a suction fan (not shown). In this way, when the web N tends to become slack, owing to the braking effect of core A1 on the paper, the excess of web is sucked inside the box 120 and forms therein a loop which is subsequently pulled out. A constant tensioning of web N is thus ensured.

A further embodiment of the tensioning system is shown in FIG. 11 which is a modified embodiment of the machine of FIG. 1. Parts which correspond to those of FIG. 1 are indicated by similar reference numbers. In this embodiment, the web N is driven around a roller 56', corresponding to roller 56 of FIG. 1 but characterized by having suction apertures on its surface. The inside of roller 56' is kept under a slight vacuum by a fan (not shown) so as to cause the web N to adhere to the outer surface of roller 56'. When the web is slowed down by the braking effect as the core A1 is inserted, the same web tends to wind itself on the surface of the roller 56', assuming the position NX shown with dotted line in FIG. 11. During the winding of the next roll, the surplus of web adhering to the roller 56' is pulled back into line.

The roller 56' thus allows the tension of web N to be kept constant without the need of supplementary members such as the suction box 120. Moreover, being a roller with fixed axis, it does not require any driving means for its displacement. Finally, it should be noted that by using a suction roller 56', there is obtained the further advantage of having a pre-determined region where the web is accumulated in case of ruptures. In fact, if the web N breaks, the winding thereof on the roller 56' avoids the risk of its being accumulated in other regions of the machine.

FIG. 10 shows an enlarged detail of the core insertion region in a modified embodiment with respect to those of FIGS. 3, 4 and 8. Parts which are similar to those of FIGS. 3, 4 and 8 are indicated by the same reference numbers. In the embodiment of FIG. 10, the surface 52 is formed by a plate 53 carrying a plurality of end prongs or fingers suitably spaced apart for the purposes to be described below. The upper winding cylinder 9 has a plurality of slots 9A having width equal to or slightly greater than the width of fingers 53B and being distributed with the same pitch of said fingers. Accordingly, the plate 53 may be moved parallel to itself according to arrow f53 in order to take up the forward position 53X shown with dotted line, where the fingers 53B are partially inserted into the slots 9A of the cylinder 9. This arrangement allows the core A1 to be inserted into the interspace 12 in a different way. In fact, in this case, the pusher means 24 pushes the core A1 up to the position shown in FIG. 10. In this position, the core A1 presses the web against the fingers 53B of the plate 53 thus causing the same web to tear. At this point, the insertion means 24 comes out of contact with the core A1, which is moved further, towards the interspace 12, directly by the fingers 53B of plate 53 by a feeding movement of said plate in the direction f53. By this movement, the core A1 with the interposed paper comes gradually in contact with the annular surfaces of the cylinder 9 disposed between the slots 9A.

Figure 6:
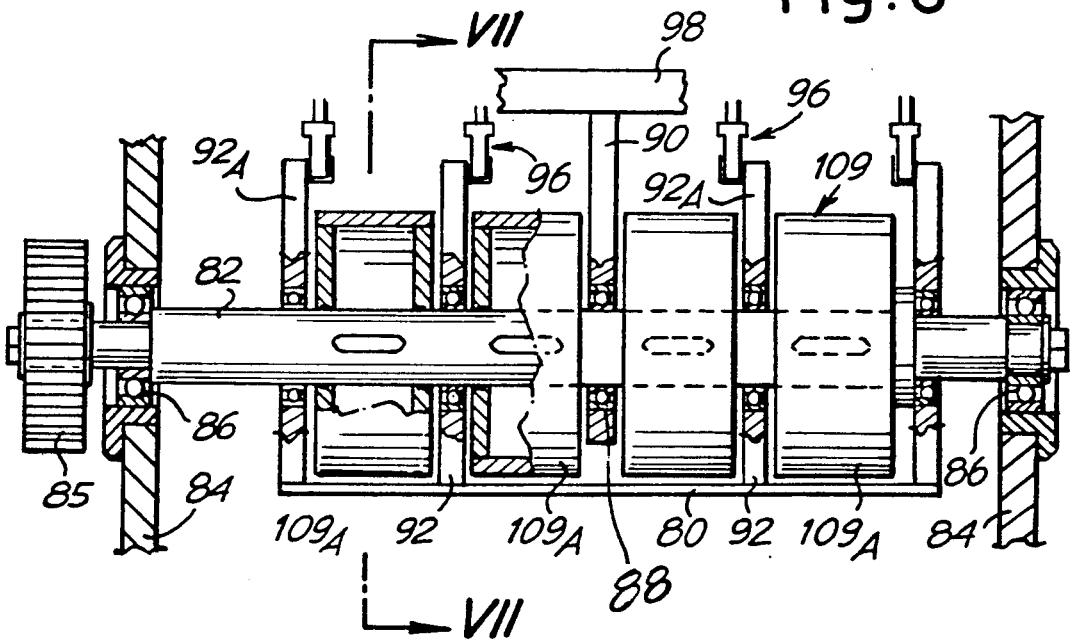
FIGS. 6 and 7 show respectively a modified embodiment of the fixed surface in a section taken on an axial plane of the first winding cylinder and in a transverse section taken on line VII—VII of FIG. 6.
Figure 7:
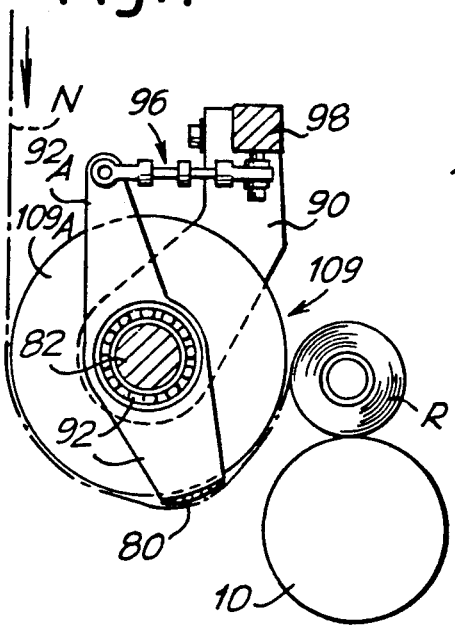

In the modified embodiment of FIGS. 6 and 7 a fixed surface is provided made up of a lining 80 with an arcuate-shaped cross-section which allows it to conform to the surface of the upper winding cylinder generally indicated by 109 (which is equivalent to cylinder 9 but differently constructed). In particular, number 82 indicates a shaft carried by the side panels 84 of the machine and rotated by a suitable drive, such as a gear 85, similar to the drive of upper winding cylinder 9 of the previous example.

The upper winding cylinder 109 is made up of a plurality of sections 109A keyed on the shaft 82 and extending longitudinally therealong by lengths significantly greater than the interspaces between them in order not to dis-affect (i.e. wrinkle) the web which they are carrying. This is unlike the example of FIGS. 1 to 5 where there is the need of using the driving roller 56. At least in one intermediate position between the supports 86, located on the side panels 84, an additional stretch-breaker support 88 may be provided for the shaft 82, which support is carried by a bracket 90 attached to the machine framework. At the ends of the set of sections 109A forming the upper winding cylinder 109, and in alignment with the interspaces between the sections 109A adjacent to cylinder 109, supports 92 are provided, which are idly mounted on the shaft 82 and which support the lining 80 at points spaced apart to a limited extent.

The supports 92 may have extensions 92A on which the corresponding means for the adjustment of the position of laminar lining 80 are made to act. These means comprise a screw-tightener reacting on a frame 98; this frame 98 may also provide a bearing for the intermediate support means 88, 90 of the shaft 82.

The lining 80 may also have a cross-section (i.e., be developed to an extent) smaller than the contact arc of paper web N over the upper winding cylinder 109. Thus this web will arrive directly at said winding cylinder, to be moved away therefrom only near the lining forming the fixed surface and having the same function as the fixed surface 52 in the structure 54 of the previous example.

It is to be understood that the present invention may be embodied in other specific forms without departing from the spirit or special attributes thereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. A rewinding machine for the formation of finished rolls (R) or logs of paper or the like from a moving web (N), especially for the formation of small rolls of paper, including an upper winding cylinder (9;109), a lower winding cylinder (10) forming with the upper one an interspace (12), the web (N) being tangent to one of said winding cylinders (9,10,109).

a mobile roller (14) able to define with said two cylinders the space for winding of the roll, means (22) for inserting individual cores (A) in said interspace, means (34,36,38) to apply adhesive on the cores, a surface (52,80) combined with one (9,109) of the two winding cylinders (9,109,10) along which the incoming web (N) is made to slide just before reaching said interspace (12), said surface (52,80) being combined with the winding cylinder (9,109) to which the web is tangent, said insertion means (22) capable of moving a core (A1) at an insertion speed which is lower than the paper-feeding speed of said web (N), said cylinders (9,109,10), insertion means (22) and said surface (52,80) being arranged so that during the insertion of the core (A1) into the interspace (12), the core cooperates with said surface (52,80) to effect a temporary braking of the web (N) lying between the same surface (52,80) and the core (A1), thus causing the tearing of the web (N) between a just-finished roll (R) and the incoming core (A1) on which the winding of the web (N) must be started, including members (58) on one side of said interspace (12) opposite said surface (52), whereby said core in course of insertion is pinched between said members (58) and said surface (52).

2. A winding machine according to claim 1 wherein said members (58) include terminal edges (58A) which are substantially opposite the terminal edge (52S) of said surface (52), so that, during the insertion of the core, it is pressed between said surface (52) and the terminal edges (58A) to cause the braking effect on the web (N) and the consequent tearing of the latter.

3. A winding machine according to claim 1 wherein said member (58) has a terminal edge (58') retracted with respect to the edge (52S) of said surface so that the core in the course of insertion is gripped between said surface (52) and said lower winding cylinder (10).

4. A winding machine according to any of claims 1 to 4, wherein said surface (52; 80) is movable.

5. A winding machine according to any one of the preceding claims 1 to 3, wherein said surface (52) has a plurality of teeth and said cylinder (9) has a plurality of slots, said teeth fitting inside the corresponding slots of the cylinder, the ends of the teeth of said surface (52) having corresponding corners (52S) projecting to a limited extent beyond the outer surface of said winding cylinder (9).

6. A winding machine according to any one of the preceding claims 2 to 3, wherein said members (58) have corners (58S) disposed in the region where the core (A1) pinches the web in the course of insertion against said surface (52), said corners enhancing the web pinching effect.

7. A winding machine according to any one of the preceding claims 1 to 3, wherein said surface (52) includes a plate (53) provided with a plurality of teeth (53A), said plate (53) being movable parallel to itself to complete the insertion of the core (A1) in the interspace (12) between the winding cylinders (9, 10), said winding cylinder (9) with which said plate (53) is associated being provided with a plurality of annular grooves (9A) which receive the teeth (53A) during the movement of said plate (53).

8. A winding machine according to any one of the preceding claims 1 to 3, wherein said surface (52; 80) includes an arcuate lining (80) close to the surface of the upper winding cylinder (109) at a region where the web N arrives at said cylinder (109); said lining (80) being angularly adjustable around the axis of the same cylinder (109).

9. A winding machine according to claim 8, wherein said winding cylinder (109) includes a bearing shaft (82) and adjacent sections (109A) of the cylinder, said arcuate lining (80) being carried by supports (92) on the bearing shaft (82) and disposed between the adjacent sections (109A) making up the winding cylinder (109) and located outside therefrom.

10. A winding machine according to claim 9, wherein said bearing shaft (82) is supported on a frame (90) by at least one bearing (88) near a space between adjacent sections (109A) of cylinder (109), and means (96) for adjusting the position of said lining (80) acting between said supports (92) and frame (90).

11. A winding machine according to any one of the preceding claims 1 to 3, including a mobile roller (56; 74; 76) upstream of said surface (52) to compensate for slackenings of the web (N).

12. A winding machine according to any one of the preceding claims 1 to 3, wherein a suction box (120) is located upstream of said winding cylinders (9, 10) transversely to the web (N), said suction box being provided with shaped edges (122, 124) against which the web slides, and a suction slot between said edges within which a surplus loop of web may be drawn.

13. A winding machine according to any one of the preceding claims 1 to 3, including a suction roller (56') around which the web (N) is carried.

14. A winding, machine according to any one of the preceding claims 1 to 3, including means to provide a temporary increase of the winding speed with respect to the web feeding speed in order to recover the excess of web (N) accumulated during the core replacement phase.

15. A method for the formation of rolls (R) of web material (N) on a core (A) which includes providing two winding cylinders (9,109,10), feeding the web (N) between said two winding cylinders and tangent to one of said cylinders, inserting the core (A) between said two cylinders into contact with said web (N), upon completion of a roll (R) moving said roll away from the formation region by slowing down one of the winding cylinders (10) while simultaneously inserting a core for the formation of a new roll close to said winding cylinders, applying adhesive to the core prior to its movement between said winding cylinders, providing a surface (52,80) near the winding cylinder to which the web (N) is tangent, pinching the web (N) between said core and said surface whereby to slow down the movement of said web and cause a tearing surface between the point of contact between the core and the surface and the point of tangency of said web on the completed roll (R), securing the free edge of the web (N) after the tear is completed to the adhesive on the core surface and winding the web on said core without reversal of advancement direction of the web, wedging the core for the formation of the successive roll between said surface (52) and a plurality of members (58) which act as core pinching surfaces associated to the other of said winding cylinders, whereby the web to be torn in pinched and braked.

16. Method according to claim 15, characterized in that the core for the formation of the successive roll becomes wedged between said surface, substantially tangent to one of said winding cylinders, and the other of said winding cylinders.

17. Method according to claim 15 or 16, characterized in that said surface (52) is movable and is caused to advance to complete the insertion of the core (A1) between the winding cylinders (9, 10).

18. Method according to claim 15 or claim 16, characterized in that the winding speed is temporarily increased with respect to the web feeding speed in order to recover up the web accumulated during the preceding core replacement phase.

* * * * *